United States Patent [19]

Oropallo

[11] 4,092,745

[45] June 6, 1978

[54] DRAIN STRUCTURE

[75] Inventor: Robert A. Oropallo, Pasadena, Calif.

[73] Assignee: American Brass & Aluminum Foundry Co., Inc., Los Angeles, Calif.

[21] Appl. No.: 749,827

[22] Filed: Dec. 13, 1976

[51] Int. Cl.[2] ..... E03C 1/26

[52] U.S. Cl. ..... 4/288; 4/292

[58] Field of Search ..... 4/289, 290, 291, 292, 4/145, 146, 189–191, 208, 286–288; 137/362; 210/163–164, 166; 220/42 B, 42 C; 240/42, 58, 161, 238, 205

[56] References Cited

U.S. PATENT DOCUMENTS

| | | | |
|---|---|---|---|
| 2,705,542 | 4/1955 | Yavitch | 4/288 X |
| 2,859,452 | 11/1958 | Seewack | 4/288 X |
| 3,420,552 | 1/1969 | Mork | 4/288 X |
| 3,668,718 | 6/1972 | Cuschara | 4/288 |
| 3,700,381 | 10/1972 | Deeke | 4/288 |
| 3,742,525 | 7/1973 | Oropallo | 4/288 |

*Primary Examiner*—Henry K. Artis

*Attorney, Agent, or Firm*—William W. Haefliger

[57] ABSTRACT

A drain assembly, for a drain floor having an opening toward which a drain pipe projects, comprises:

(a) a tubular plastic body sized to exteriorly fit the drain floor opening, the body having an external thread, and a nut threadably engaging the body thread and rotatable relative to the body, the nut defining an exterior flange, the body and nut consisting of molded plastic material, (b) a plate defining an upper flange overlapping the top of the body, and a grille bounded by the upper flange and overlapping the upper interior of the body, (c) and a tubular base having a flange attached to the nut flange at the underside thereof, the base having a tubular portion projecting downwardly for reception of the upper extent of said pipe, said base consisting of molded plastic material.

11 Claims, 5 Drawing Figures

DRAIN STRUCTURE

BACKGROUND OF THE INVENTION

This invention relates generally to flow drain installations, and more particularly concerns plastic drains which are adjustable and suitable for many different purposes.

It has long been customary to install brass drains in shower stalls. Such installation is time consuming and expensive due to cost of brass metal and to the time consumed in preparing and applying lead paste to the joint as packing between the fitting and drain pipe. An advanced type plastic drain for use in shower stalls is described in my U.S. Pat. No. 3,742,525. The present invention makes plastic drains applicable to most all types of floor construction and finishes, and extends their usage to many types of floor installations in both commercial and residential buildings, in addition to shower stalls. Quick installation of the improved drains is facilitated by their improved construction.

SUMMARY OF THE INVENTION

It is a major object of the invention to provide an advanced type drain assembly suitable for general usage in a wide variety of drain floor applications. Basically, the drain assembly comprises:

(a) a tubular plastic body sized to exteriorly fit the drain floor opening, the body having an external thread, and a nut threadably engaging the body thread and rotatable relative to the body, the nut defining an exterior flange, the body and nut consisting of molded plastic material, (b) a plate defining an upper flange overlapping the top of the body, and a grille bounded by the upper flange and overlapping the upper interior of the body, (c) and a tubular base having a flange attached to the nut flange at the under side thereof, the base having a tubular portion projecting downwardly for reception of the upper extent of said pipe, said base consisting of molded plastic material.

As will be seen, the nut defines at least one weep hole to communicate through the side wall of the nut at flange level to allow inward escape of trapped air of flowable floor material; adjustable threaded fasteners interconnect a wide flange on the tubular base with the nut flange, to accommodate sealing paper or other material between the wide flanges on the nut and base, the base flange extending outwardly beyond the nut flange to support both paper and tar layers; the base depending tubular portion provides a stop shoulder to limit reception of the drain pipe so that the pipe may be bonded to the base, in situ, in one form of the invention; and in another form of the invention, sealing means such as an elastomeric seal is located in the base tubular portion to seal off against the drain pipe to accommodate to different extents of drain pipe reception into the fitting.

These and other objects and advantages of the invention, as well as the details of illustrative embodiment will be more fully understood from the following description and drawings, in which:

DRAWING DESCRIPTION

DETAILED DESCRIPTION

Figure 1:
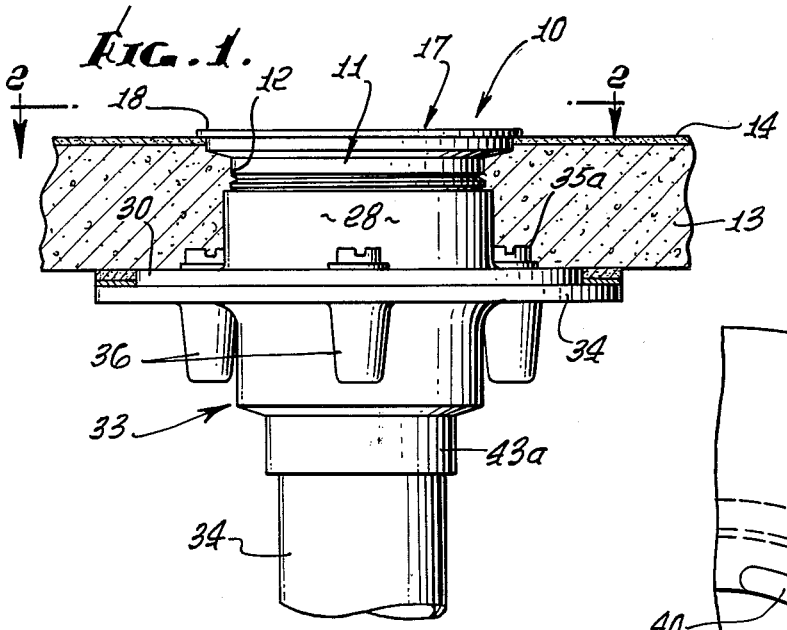
FIG. 1 is an elevation.
Figure 4:
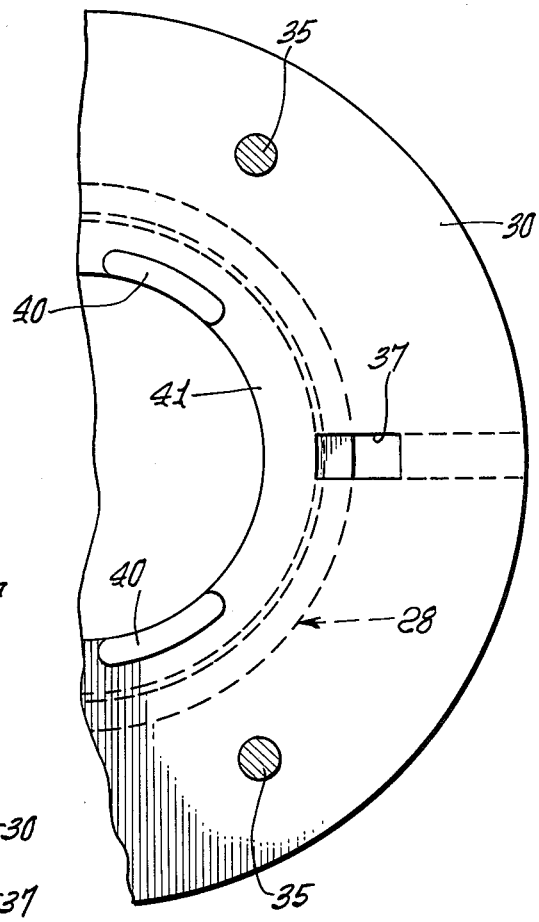
FIG. 4 is a fragmentary section, taken on lines 4—4 of FIG. 3.
Figure 2:
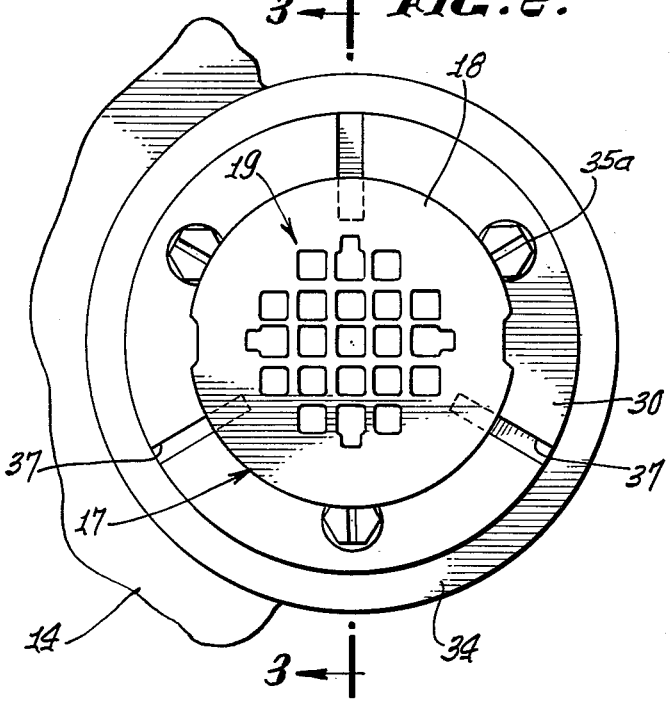
FIG. 2 is a plan view in lines 2—2 of FIG. 1.

In FIGS. 1-4, the drain fitting assembly 10 includes a tubular plastic body 11 sized to exteriorly fit an opening 12 in a drain floor. The latter may include a layer of cement or concrete 13, or other poured material, and an upper tile layer 14. An outer flange 15 integral with the body 11 overhangs body exterior threading 16.

A plate 17 defines an upper flange 18 overlapping the top of body 11, including flange 15. The plate includes a grille 19 bounded by flange 18 and overlying the upper interior of the body. The plate also provides a depending cylindrical portion 20 downwardly rearwardly received in a counter bore 21 defined by the body, and the lower rim 24 of cylindrical portion 20 may seat on a ledge or shoulder 22 that is formed between body counter bore 21 and bore 23. Detent means is formed by the portion 20 and the body to releasably retain the plate in position at the top of the body. Such detent means may include an annular protrusion 26 on the portion 20, and an annular recess 27 in the body. The portrustion snapping into the recess upon full reception of the plate portion 20 into the counter bore.

A nut 28 has internal threading 29 threadably engaging the body thread 16, whereby the nut is rotatable relative to the body while engaged thereto. The nut defines an external wide flange 30 which extends annularly beneath the cement flooring 13, and rotation of the nut on the body adjusts the flange to the underside of the flooring 13 provided or to be provided (as by pouring of the cement, concrete or other flowable and hardenable material about the nut and body). The nut and body may advantageously consist of molded ABS, PVC, or other plastic material, the high cost of metal being obviated.

In accordance with an important aspect of the invention, a tubular base 33 is provided to simply, rapidly and most advantageously couple drain pipe 34 to the relatively adjustable body and nut. The base 33 also includes a wide flange 34 removably attached to the nut flange 30, as by fasteners 35. For this purpose, the plastic base may have integral projections 36 depending from the flange 34 and forming interior threading 37. The fastener heads **35*a* are therefore located above flange 30, to be retained, against loosening, by the poured and hardened material 13; however, they may initially be tightened from above since they are located generally outside a cylinder defined by the outermost edge of flange 15. Sealant paper or other layered material 36 is located between and clamped by the flanges 30 and 34**.

The nut 28 defines at least one weep hole 137 and and preferably several circularly spaced about axis 38, the hole or holes extending through the side wall of the nut at the level of flange 30 to communicate between the exterior and upper interior 39 of the tubular base. Accordingly, trapped air may escape to interior 39 as cement 13 is poured in place. The nut also includes circularly spaced, downward projections 40 extending into the upper interior 39 of the base, the weep holes located between such projections. Projections extend downwardly from an interior flange 41 defined by the nut, and act as centering guides and stiffeners. Bore 42 of the base tubular portion 43 lies closely adjacent the projections 40.

Figure 3:
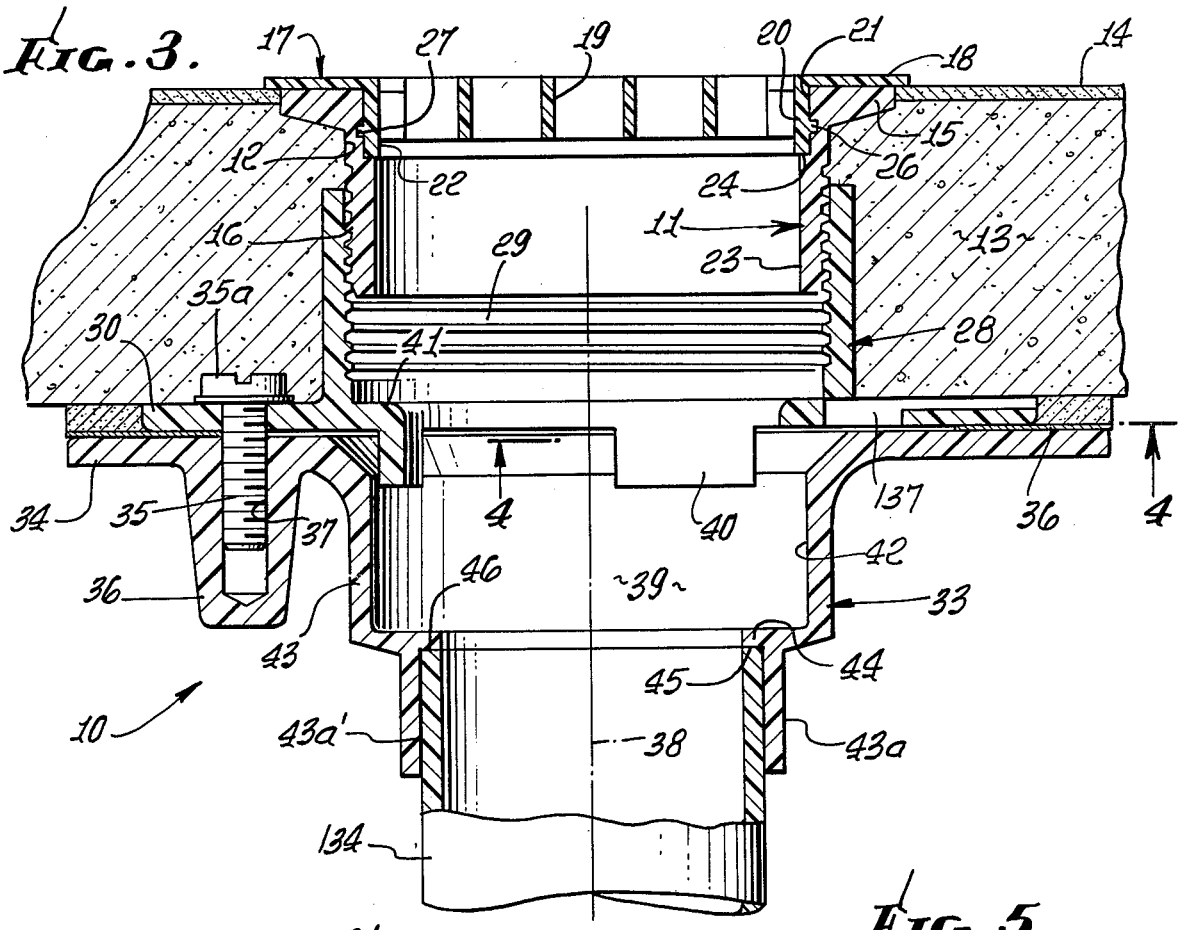
FIG. 3 is an enlarged elevation, taken in section on lines 3—3 of FIG. 2.

In the form of the invention shown in FIG. 3, the tubular portion 43 defines a radially inwardly projecting annular flange 44 forming a downwardly facing stop shoulder 45 to limit the uppermost end extent 46 of pipe 134. Note that the pipe is closely received by a downward extension 43*a* of the portion 43, whereby the pipe may be bonded to the bore 43*a'*. In this regard, the base 33 may also consist of molded plastic material (such as ABS or PVC), The pipe itself may consist of molded plastic, and glue may be used to sealingly adhere the pipe to bore 43*a*.

Figure 5:
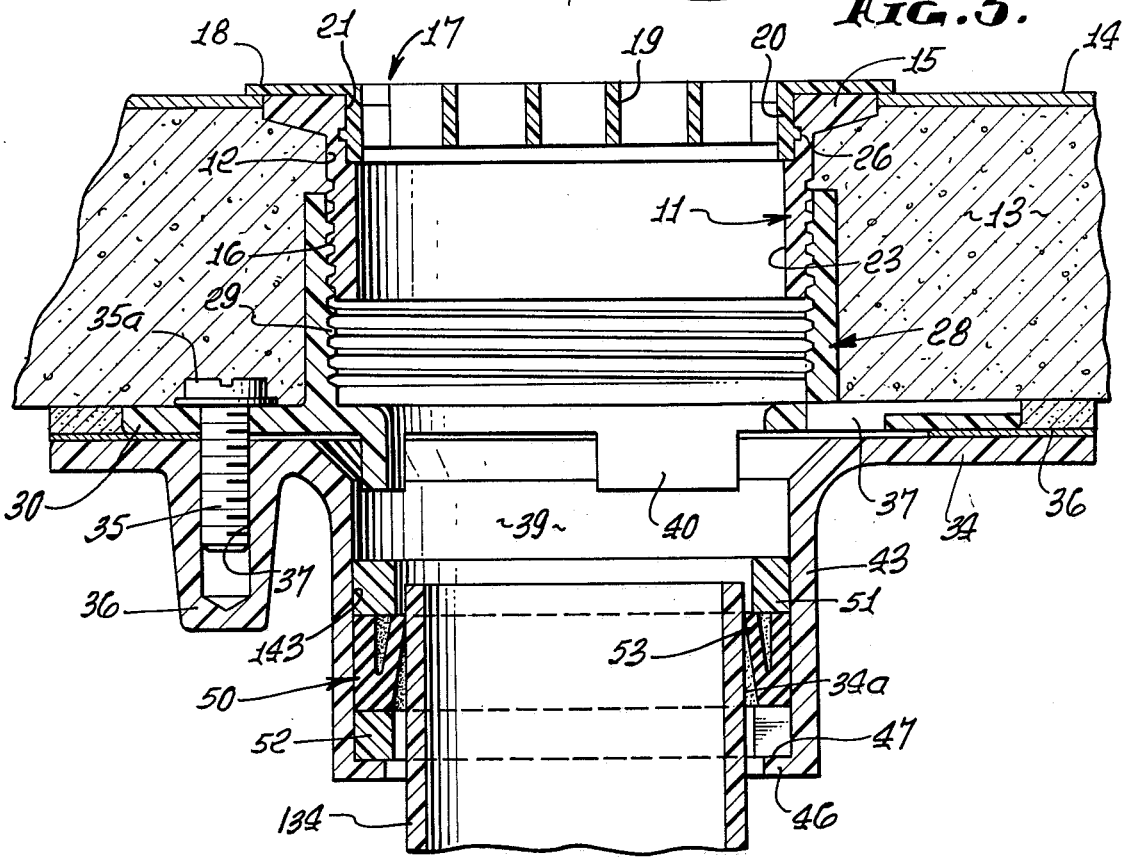
FIG. 5 is a view like FIG. 3, but showing a modification.

In FIG. 5, the elements remain the same as in FIG. 3, retain the same identifying numbers. In this modification, the base tubular portion 43 has a radially inwardly projecting bottom lip 46 defining an upwardly facing shoulder or ledge 47. Also, annular means is provided and suspended on ledge 47 for sealing off between the tubular portion 43 and the upper extent of the pipe 134 received therein. Such means may advantageously comprise an annular elastomeric seal 50, and seal retainer rings 51 and 52 located above and below the seal. The seal 50 is shown as including annular, flexible lip 53 projecting upwardly and inwardly to compressively engage and seal off against the pipe exterior surface 34*a*. Accordingly, the FIG. 3 construction may be considered as self-caulked. The plastic rings 51 and 52 may be suitably bonded to the bore 143 of the plastic tubular portion, to retain the elastomeric seal in fixed position in the tubular portion 43.

I claim:

1. In a drain assembly for a drain floor having an opening toward which a drain pipe projects, the combination comprising:

(a) a tubular plastic body sized to exteriorly fit the drain floor opening, the body having an external thread, and a nut threadably engaging the body thread and rotatable relative to the body, the nut defining an exterior flange, the body and nut consisting of molded plastic material, the body and nut having a common axis, (b) a plate defining an upper flange overlapping the top of the body, and a grille bounded by the upper flange and overlapping the upper interior of the body, (c) and a tubular base having a flange attached to the nut flange at the underside thereof, the base having a tubular portion projecting downwardly for reception of the upper extent of said pipe, said base consisting of molded plastic material, (d) said nut including circularly spaced downward projections extending into the upper interior of the base, the nut defining at least one weep hole extending through the side of the nut at approximately the level of the nut flange to directly communicate with the space between the projections, said projections acting as stiffeners and centering guides, said projections projecting closer to said axis than said thread.

2. The combination of claim 1 wherein the projections extend downwardly from the level of said nut flange to at least the level of the base flange and into loose telescopic interfit with a bore defined by said base.

3. The combination of claim 2 wherein the weep hole directly communicates with the space between two of said projections.

4. The combination of claim 1 including threaded fasteners interconnecting said nut and base flanges, the base having projections integral with and depending from the base flange and forming interior threads interfitting threaded shanks defined by said fasteners.

5. The combination of claim 1 wherein the plate includes a cylindrical portion downwardly received in a counter bore defined by the body, there being detent means formed by the plate cylindrical portion and the body to releasably retain the plate in position at the top of the body.

6. The combination of claim 1 including cement flooring extending about the body and nut above the nut flange.

7. The combination of claim 6 wherein the base flange has an outer portion projecting radially outwardly to greater extent than the nut flange, and including tar and paper layers located between the base flange outer portion and the underside of the cement flooring.

8. The combination of claim 1 wherein said base tubular portion defines a radially inwardly projecting annular shoulder facing downwardly to provide a stop for the uppermost extent of said pipe.

9. The combination of claim 1 wherein said base tubular portion defines a radially inwardly projecting annular shoulder facing upwardly to provide a ledge, and annular means on the ledge for sealing off between said tubular portion of the base and the upper extent of the pipe received therein.

10. The combination of claim 9 wherein said means comprises an annular elastomeric seal, and seal retainer rings located above and below the seal.

11. The combination of claim 10 wherein the seal includes an annular lip which projects upwardly and inwardly to seal off against the pipe exterior surface.

* * * * *